US007018488B2

(12) United States Patent
Toyooka et al.

(10) Patent No.: US 7,018,488 B2
(45) Date of Patent: Mar. 28, 2006

(54) STEEL PIPE FOR USE IN REINFORCEMENT OF AUTOMOBILE AND METHOD FOR PRODUCTION THEREOF

(75) Inventors: Takaaki Toyooka, Handa (JP); Masanori Nishimori, Handa (JP); Yoshikazu Kawabata, Handa (JP); Akira Yorifuji, Handa (JP); Motoaki Itadani, Handa (JP); Takatoshi Okabe, Handa (JP); Masatoshi Aratani, Handa (JP)

(73) Assignee: JFE Steel Corporation, Tokyo (JP)

( * ) Notice: Subject to any disclaimer, the term of this patent is extended or adjusted under 35 U.S.C. 154(b) by 32 days.

(21) Appl. No.: 10/049,510

(22) PCT Filed: Jun. 14, 2001

(86) PCT No.: PCT/JP01/05056

§ 371 (c)(1),
(2), (4) Date: Aug. 26, 2002

(87) PCT Pub. No.: WO01/96625

PCT Pub. Date: Dec. 20, 2001

(65) Prior Publication Data

US 2003/0051782 A1 Mar. 20, 2003

(30) Foreign Application Priority Data

Jun. 14, 2000 (JP) ..... 2000-178246

(51) Int. Cl.
*C22C 38/02* (2006.01)
*C22C 38/06* (2006.01)
*C21D 8/06* (2006.01)

(52) U.S. Cl. ..... 148/320; 148/593

(58) Field of Classification Search ..... 148/320, 148/593

See application file for complete search history.

(56) References Cited

U.S. PATENT DOCUMENTS

| | | | |
|---|---|---|---|
| 5,370,751 A | 12/1994 | Von Hagen et al. | |
| 5,374,322 A | 12/1994 | Okada et al. | |

FOREIGN PATENT DOCUMENTS

| | | | |
|---|---|---|---|
| EP | 0 757113 | | 2/1997 |
| EP | 0 994 197 | | 4/2000 |
| JP | 4-191325 | | 7/1992 |
| JP | 4-276018 | | 10/1992 |
| JP | 4-289122 | | 10/1992 |
| JP | 6-179945 | * | 6/1994 |
| JP | 7-18374 | | 1/1995 |
| JP | 7-278730 | | 10/1995 |
| JP | 8-337817 | | 12/1996 |
| JP | 9-104921 | | 4/1997 |
| JP | 10-1740 | | 1/1998 |

* cited by examiner

*Primary Examiner*—Deborah Yee
(74) *Attorney, Agent, or Firm*—Young & Thompson

(57) ABSTRACT

A steel tube having a composition which contains: 0.05 to 0.30% of C; 1.8 to 4.0% of Mn; Si; and Al is subjected to a diameter-reducing rolling process in which the total diameter-reduction rate is no less than 20% and the temperature at which the diameter-reducing rolling process is finished is no higher than 800° C., whereby a structure constituted of martensite and/or bainite or further of ferrite is obtained as a transformation product from the deformed γ. As a result, a steel tube having tensile strength of 1000 MPa or more and excellent three-point-bending property can be obtained. The composition of the steel tube of the present invention may further include at least one type of element selected from the group consisting of Cu, Ni, Cr and Mo, or at least one type of element selected from the group consisting of Nb, V, Ti and B, or at least of one type selected from the group consisting of REM and Ca.

9 Claims, 2 Drawing Sheets

STEEL PIPE FOR USE IN REINFORCEMENT OF AUTOMOBILE AND METHOD FOR PRODUCTION THEREOF

TECHNICAL FIELD

The present invention relates to a steel tube for reinforcing a automobile door. Specifically, the present invention relates to a steel tube which has high tensile strength and excellent three-point-bending property and has, in particular, a large amount of buckling limit deformation. The present invention also relates to a method of producing the aforementioned steel tube for reinforcing a automobile door.

In the present invention, the "excellent three-point-bending property" indicates that, in what is called "a three point bending test" in which a steel tube is placed over a pair of support tools distanced by a predetermined span L and the center portion of the steel tube is pressed by a bending tool having a curvature of radius R as shown in FIG. 1, the maximum pressing amount which buckling occurs (which will be referred to as "the buckling limit pressing amount" hereinafter) is relatively large, and also, in the graph representing the relationship between the pressing load and the pressing amount of the steel tube (refer to FIG. 2), the area defined by "the pressing load-pressing amount curve from the start of pressing to the buckling limit pressing amount" and the amount of deformation axis (the hatched portion of FIG. 2), i.e., the amount of energy absorbed by the steel tube before the buckling occurs is relatively large. More specifically, when a steel tube of 31.8 mm $\phi$ (steel thickness being 1.6 mm) absorbs energy of 450 J or more before the deformation reaches the buckling limit pressing amount (i.e., the buckling limit deformation amount) at a three point bending test with the span L being 980 mm, the steel tube is regarded as a steel tube which is "excellent in the three-point-bending property".

BACKGROUND ART

In order to ensure safety of passengers in a automobile at the time of collision, improvement of the collision safety property of a automobile body is increasingly on demand in recent years. Due to this, in the automobile body, increasing of the strength of the side portion of a automobile i.e., increasing of the strength of a automobile door is particularly required and thus a bar for reinforcing a automobile door is always provided in a automobile door, in recent years. Here, in order to reduce the weight of a automobile body, a steel tube is increasingly in use for the bar for reinforcing a door.

A steel tube for a automobile door reinforcing bar is required to have high strength, so that the automobile door reinforcing bar can achieve the intended effect in application thereof. Therefore, a steel tube whose strength has been increased is generally used for a automobile door reinforcing bar. Conventionally, a electric resistance welded tube is used as a steel tube for automobile door reinforcing bar. Specifically, the off-line QT (quench and temper) type steel tube whose strength has been increased by the off-line QT treatment such as induction quenching has conventionally been used, or the as rolled type steel tube which is produced by electric resistance welding a steel sheet having high strength has conventionally been used (here, the steel sheet is strengthed by the QT treatment at the stage of producing a thin steel sheet as the base material of a electric resistance welded tube).

SUMMARY OF THE INVENTION

However, in the case of the off-line quench and temper (QT) type steel tube, there is a problem that the production steps are complicated, a relatively long period is required for production and the production cost is relatively high, because the quench and temper treatment has to be carried out at "off-line". On the other hand, in the case of the as rolled type steel tube, there is a problem that cold forming strain generated during tube forming tends to remain, whereby the steel tube buckles at a relatively early stage of the three point bending test and thus exhibits poor three-point-bending property. In addition, in the case of the as rolled type steel tube, since the steel sheet is subjected to the QT treatment at the stage of the thin steel sheet production and thereafter the steel tube is produced from the steel sheet, there is a problem that the welded portion by electric resistance welding at which the ends of the steel sheet are electric resistance-welded (the induction welded portion) tends to be softened due to heat affection. Further, since the thin steel sheet as the base material of steel tube has extremely high strength, there arises a problem that the steel tube tends to suffer from a relatively large amount of springback at the time of tube forming, the steel tube is hard to form and the production facility must be large-scale, whereby the facility cost becomes high.

The present invention has an object to solve the aforementioned problems of the prior art, to propose a steel tube for reinforcing a automobile door which has high strength (the tensile strength of no smaller than 1000 MPa) and excellent three-point-bending property, and to propose a method of producing the same steel tube.

In order to solve the aforementioned problems, the inventors of the present invention have assiduously studied for means to enhance strength and three-point-bending property of a steel tube at the same time, without carrying out any off-line heat treatment. As a result, the inventors have found the following items. First, by subjecting a steel tube having a uniquely restricted composition to a diameter-reducing rolling process whose total diameter-reduction rate is no less than 20%, at a temperature within the "$\alpha+\gamma$" two-phase region or slightly above the region, and then cooling the steel tube, the structure of the steel tube becomes a structure which includes hard martensite and bainite as main components, obtained as a result of transformation of the deformed austenite, and ferrite, in a mixed manner. By utilizing the steel tube having the aforementioned structure, a steel tube in which high strength and excellent three-point-bending property are compatible without carrying out the conventional, specific off-line heat treatment (quench and temper treatment). Such significant improvement of the three-point-bending property is achieved presumably because the structure of the steel tube is mainly constituted of martensite or bainite which has been transformed from the deformed $\gamma$. On the other hand, the structure of the conventional off-line QT type steel tube is mainly constituted of martensite or bainite which has been transformed from the reheated austenite ($\gamma$). The three-point-bending property of the conventional as rolled type steel tube, and the three-point-bending property of the steel tube having a structure mainly composed of martensite or bainite which has been transformed from the deformed $\gamma$ (the steel tube of the present invention) are shown in FIG. 3, in a manner of comparing the former with the latter. From FIG. 3, it is understood that the buckling limit pressing amount (the buckling limit deformation amount) of the steel tube of the present invention is relatively large and thus absorbs a relatively large amount of energy as compared with the conventional steel tube.

The present invention has been achieved by further studying the aforementioned discoveries. The present invention is constituted of a novel technique whose idea is essentially different from that of the conventional steel tube for reinforcing a automobile door.

Specifically, the first aspect of the present invention provides a steel tube for reinforcing a automobile door, having a composition comprising: 0.05 to 0.30 mass % of C; 0.01 to 2.0 mass % of Si; 1.8 to 4.0 mass % of Mn; 0.005 to 0.10 mass % of Al; and the remainder as Fe and unavoidable impurities, wherein the steel tube has tensile strength of no less than 1000 MPa and excellent three-point-bending property. Further, in the first aspect of the present Invention, it is preferable that the steel tube has a structure which is constituted of martensite and/or bainite or a structure which is a mixture of martensite and/or bainite and ferrite, and the martensite and/or bainite is a transformation product obtained as a result of transformation of the deformed austenite. Yet further, in the first aspect of the present invention, it is preferable that the content of ferrite in the structure, expressed as the area ratio, is no more than 20%. Yet further, in the first aspect of the present invention, it is preferable that the yield ratio of the steel tube is no larger than 80%.

Yet further, in the first aspect of the present invention, it is preferable that the steel tube has at least one composition selected from the group consisting of composition A, composition B and composition C described below, in addition to the aforementioned composition.

Composition A: at least one type of element selected from the group consisting of: no more than 1 mass % of Cu; no more than 1 mass % of Ni; no more than 2 mass % of Cr; and no more than 1 mass % of Mo.

Composition B: at least one type of element selected from the group consisting of: no more than 0.1 mass % of Nb; no more than 0.5 mass % of V; no more than 0.2 mass % of Ti; and no more than 0.003 mass % of B.

Composition C: at least one selected from the group consisting of: no more than 0.02 mass % of REM; and no more than 0.01 mass % of Ca.

The second aspect of the present invention provides a method of producing a steel tube for reinforcing a automobile door, comprising the steps of: preparing a mother steel tube having a composition which includes: 0.05 to 0.30 mass % of C; 0.01 to 2.0 mass % of Si; 1.8 to 4.0 mass % of Mn; 0.005 to 0.10 mass % of Al; and the remainder as Fe and unavoidable impurities; subjecting the mother steel tube to a heating or soaking treatment; and thereafter, subjecting the mother steel tube to a diameter-reducing rolling process in which the total diameter-reduction rate is no less than 20% and the temperature at which the diameter-reducing rolling process is finished is no higher than 800° C. Further, in the second aspect of the present invention, it is preferable that the steel tube has at least one composition selected from the group consisting of composition A, composition B and composition C described below, in addition to the aforementioned composition.

Composition A: at least one type of element selected from the group consisting of: no more than 1 mass % of Cu; no more than 1 mass % of Ni; no more than 2 mass % of Cr; and no more than 1 mass % of Mo.

Composition B: at least one type of element selected from the group consisting of: no more than 0.1 mass % of Nb; no more than 0.5 mass % of V; no more than 0.2 mass % of Ti; and no more than 0.003 mass % of B.

Composition C: at least one selected from the group consisting of: no more than 0.02 mass % of REM; and no more than 0.01 mass % of Ca.

THE PREFERRED EMBODIMENT OF THE PRESENT INVENTION

Figure 1:
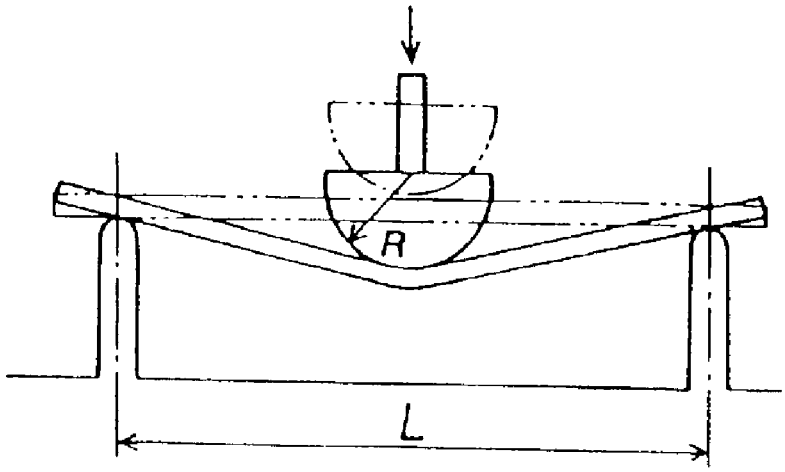
FIG. 1 is an explanatory diagram which shows the scheme of a three point bending test.

The steel tube for reinforcing a automobile door of the present invention is a steel tube which has tensile strength TS of no smaller than 1000 MPa and has excellent three-point-bending property. In addition, the steel tube for reinforcing a automobile door of the present invention preferably exhibits the yield ratio of no higher than 80%. The steel tube of the present invention may be any of a welded steel tube such as butt-welded steel tube and electric resistance welded tube, and seamless steel tube, and is not restricted by the method of producing each mother steel tube.

Next, the reason for restricting the composition of the steel tube for reinforcing a automobile door of the present invention will be described. It should be note that "mass %" will be simply referred to as "%" hereinafter.

C: 0.05% to 0.30%

C is an element which is solid-solved in the base material or precipitated as a carbide, thereby increasing the strength of steel. In the present invention, the content of C must be no less than 0.05%, so that the desired strength of the steel can be reliably obtained. When the content of C exceeds 0.30%, the weldability property of the steel is deteriorated. Accordingly, in the present invention, the content of C is restricted within the range of 0.05 to 0.30%.

Si: 0.01% to 2.0%

Si is an element which serves as a deoxidizing agent and is solid-solved in the base material, thereby increasing the strength of the steel. Such the effect of Si is observed when the content of Si is no less than 0.01%, preferably no less than 0.1%. However, when the content of Si exceeds 2.0%, the ductility of the steel is deteriorated. Accordingly, in the present invention, the content of Si is restricted within the range of 0.01 to 2.0%. In order to achieve excellent balance between strength and ductility, the content of Si is preferably within the range of 0.10 to 1.5%.

Mn: 1.8% to 4.0%

Mn is an element which serves for increasing the strength of the steel, improving the hardenability property and accelerating formation of martensite and bainite during cooling after the rolling process. Such the effect of Mn is observed when the content of Mn is no less than 1.8%. However, when the content of Mn exceeds 4.0%, ductility of the steel is deteriorated. Accordingly, in the present invention, the content of Mn is restricted within the range of 1.8 to 4.0%. In order to reliably obtain high tensile strength of 1000 MPa or more without conducting the off-line heat treatment, the content of Mn is preferably within the range of 2.5 to 4.0%, and more preferably within the range of 2.5 to 3.5%.

Al: 0.005% to 0.10%

Al is an element which effects deoxidization and also makes grains fine. Due to this grain-refining effect, Al makes the structure fine at the stage of mother tube, thereby further enhancing the effect of the present invention. In order to reliably achieve the aforementioned effect, the content of Al must be no less than 0.005%. However, when the content of Al exceeds 0.10%, the amount of oxide-based inclusion is increased and cleanness of the steel deteriorates. Accordingly, in the present invention, the content of Al is restricted within the range of 0.001 to 0.10%. The content of Al is preferably in the range of 0.015 to 0.06%.

In addition to the aforementioned base composition, it is preferable that at least one alloy element group selected from the group consisting of Composition A, Composition B and Composition C described below is contained, according to necessity.

Composition A: at least one type of element selected from the group consisting of: no more than 1% of Cu; no more than 1% of Ni; no more than 2% of Cr; and no more than 1% of Mo.

Cu, Ni, Cr and Mo are elements which increase strength of the steel. These elements may be contained solely or as a combination of two or more types, according to necessity. These elements serve for lowering the transformation temperature and making the structure fine. However, when the content of Cu is too much (specifically, more than 1%), the hot workability of the steel deteriorates. Ni increases tensile strength and improves toughness. However, when the content of Ni exceeds 1%, the effect achieved by Ni reaches the plateau and hardly improves any more however the content of Ni is increased. When the content of Cr or that of Mo is too much (specifically, when the content of Cr exceeds 2% or when the content of Mo exceeds 1%), not only the weldability and ductility of the steel deteriorate, but also the production cost of the steel increases. Accordingly, it is preferable that the Cu content is no more than 1%, the Ni content is no more than 1%, the Cr content is no more than 2%, and the Mo content is no more than 1%. It is more preferable that the Cu content is in the range of 0.1 to 0.6%, the Ni content is in the range of 0.1 to 0.7%, the Cr content is in the range of 0.1 to 1.5%, and the Mo content is in the range of 0.05 to 0.5%.

Composition B: at least one type of element selected from the group consisting of: no more than 0.1% of Nb; no more than 0.5% of V; no more than 0.2% of Ti; and no more than 0.003% of B.

Nb, V, Ti and B are elements which are precipitated as carbides, nitrides or carbo-nitrides thereby contributing to strengthing of the steel. In particular, in a steel tube having a welded portion which is heated to a high temperature, the precipitates of these elements make grains fine during the heating process at the time of welding, serve as precipitation nuclei of ferrite during the cooling process of welding, and effectively prevent the welded portion from becoming hard. These elements may be added solely or as a combination of two or more elements, according to necessity. However, when these elements are added too much, the weldability and ductility of the steel are both deteriorated. Accordingly, in the present invention, it is preferable that the content of Nb is restricted to no more than 0.1%, the content of V is restricted to no more than 0.5%, the content of Ti is restricted to no more than 0.2%, and the content of B is restricted to no more than 0.003%. More preferably, the content of Nb is in the range of 0.005 to 0.05%, the content of V is in the range of 0.05 to 0.1%, the content of Ti is in the range of 0.005 to 0. 10%, and the content of B is in the range of 0.0005 to 0.002%.

Composition C: at least one selected from the group consisting of: no more than 0.02 mass % of REM; and no more than 0.01 mass % of Ca.

REM and Ca are crystallized as sulfides, oxides or oxisulfides, make the shape of the inclusion spherical thereby improving the formability, and effectively prevent the welded portion of a steel tube from becoming hard. REM, Ca may be added solely or as a combination of two elements, according to necessity in the present invention. However, when the content of REM exceeds 0.02% or the content of Ca exceeds 0.01%, there will be present too much inclusion in the steel, whereby the cleanness and ductility of the steel are deteriorated. Accordingly, it is preferable that the content of REM is restricted to no more than 0.02% and the content of Ca is restricted to no more than 0.01%. When the content of REM is less than 0.004% or when the content of Ca is less than 0.001%, the aforementioned effects by REM, Ca may not be sufficient. Therefore, it is preferable that the content of REM is no less than 0.004% and the content of Ca is no less than 0.001%.

The remainder other than the aforementioned elements of the composition is constituted of Fe and unavoidable impurities. Examples of the unavoidable impurities include: no more than 0.025% of P; no more than 0.020% of S; no more than 0.010% of N; and no more than 0.006% of O.

P: 0.025% or Less

It is preferable that the content of P is reduced as much as possible because P is locally segregated in grain boundary and deteriorates ductility of the steel. However, the presence of P is acceptable if the content of P is no more than 0.025%.

S: 0.020% or Less

It is preferable that the content of S is reduced as much as possible because S increases the amount of sulfides and deteriorates cleanness of the steel. However, the presence of S is acceptable if the content of S is no more than 0.020%.

N: 0.010% or Less

It is preferable that the content of N is reduced as much as possible because N deteriorates weldability property of the steel. However, the presence of N is acceptable if the content of N is no more than 0.010%.

O: 0.006% or Less

It is preferable that the content of O is reduced as much as possible because O deteriorates cleanness of the steel. However, the presence of O is acceptable if the content of O is no more than 0.006%.

The steel tube of the present invention has a structure which is constituted of martensite and/or bainite or a structure which is a mixture of martensite and/or bainite and ferrite. The martensite and/or bainite of the aforementioned structure is a transformation product obtained as a result of transformation of the deformed austenite (γ) which has been diameter-reducing-rolled, and significantly contributes to achieving higher strength and lower yield ratio (YR) and improving the three-point-bending property. In the present invention, the structure may include ferrite in addition to the primary phase of martensite and/or bainite. It is preferable that the content of ferrite, expressed as the area ratio, is no more than 20%. When the amount of ferrite exceeds 20% by the area ratio, the high strength of the desired level cannot be reliably obtained. Accordingly, the amount of ferrite is preferably no larger than 20% by the area ratio.

Next, the method of producing the steel tube of the present invention will be described hereinafter.

Although the method of producing the steel tube of the present invention employs a steel tube having "a specific composition" as a mother steel tube, the method of producing the mother steel tube(tube forming) is not particularly restricted. Examples of the method of producing the mother steel tube include: the electric resistance welding which utilizes the high frequency current in cold roll forming or hot roll forming (the mother tube of such a type is called "electric resistance welded tube", and especially called "hot electric resistance welded tube" in the case of hot rolling); the solid phase pressure welding in which both edge portions of an open tube are heated to the solid phase pressure welding temperature range, whereby the edge portions are pressure-welded (the mother tube of such a type is called "solid phase pressure welded tube); the butt-welding (the mother tube of such a type is called "butt-welded tube"); and the Mannesmann type piercing process (the mother tube of such a type is called "seamless steel tube"). Any of the aforementioned methods can be suitably used.

The mother steel tube having the aforementioned composition is subjected to a diameter-reducing rolling process in which the total diameter-reduction rate is no less than 20% and the temperature at which the diameter-reducing rolling process is finished is no higher than 800° C., preferably after being subjected to the heating or soaking treatment. The temperature at which the heating or soaking treatment is carried out is not particularly restricted, as long as the temperature at which the diameter-reducing rolling process is finished is no higher than 800° C. In the case in which the mother steel tube is once cooled to the room temperature, the heating treatment must be carried out. However, in this case, the temperature at which the heating treatment is conducted may be flexibly adjusted so that the temperature at which the diameter-reducing rolling process is finished is no higher than 800° C., preferably within the "α+γ" two-phase range. For example, the temperature at which the heating treatment is conducted may be adjustingly selected between $Ac_3$ transformation point and $Ac_1$ transformation point or at $Ac_3$ transformation point or higher, and then cooled, so that the temperature at which the diameter-reducing rolling process is finished is no higher than 800° C., preferably within the "α+γ" two-phase range. In a case in which the mother steel tube is produced in the hot roll forming or warm roll forming, the mother steel tube may be directly subjected to re-heating or soaking treatment before the mother steel tube is cooled to the room temperature, so that the temperature at which the diameter-reducing rolling process is finished is no higher than 800° C., preferably within the "α+γ" two-phase range.

When the total diameter-reduction rate is less than 20%, the deformation of the austenite is insufficient and the low-temperature transformation phase (martensite or bainite) produced thereafter does not have sufficient strength, whereby tensile strength of the steel cannot be raised to 1000 MPa or higher.

The temperature at which the diameter-reducing rolling is carried out is set so that the temperature at which the diameter-reducing rolling process is finished is no higher than 800° C. The temperature at which the diameter-reducing rolling is carried out is preferably set within the "α+γ" two-phase range.

When the temperature at which the diameter-reducing rolling process is finished exceeds 800° C., the rolling strain provided to the austenite is instantly lost, whereby the low-temperature transformation phase (martensite or bainite) produced as a result of transformation from the austenite does not have sufficient strength and thus the high tensile strength TS of 1000 MPa or more cannot be achieved. In order to achieve such a high strength, the temperature at which the diameter-reducing rolling process is finished is preferably no lower than the temperature at which the martensite or bainite transformation is completed.

After being reduced, the mother steel tube is cooled according to the conventional, standard method. This cooling process may be performed by way of either air or water.

In the present invention, the diameter-reducing rolling is preferably rolling under lubrication (lubrication rolling). By conducting lubrication rolling as the diameter-reducing rolling, the distribution of strain in the thickness direction is made uniform, the structure can be made uniformly fine in the thickness direction, and the formation of the texture can also be made uniform in the thickness direction. On the contrary, in the case of non-lubrication rolling, the rolling strain concentrates at the material surface layer portion due to the shearing effect, whereby the structure is formed non-uniformly in the thickness direction.

The method of diameter-reducing-rolling is not particularly restricted. In the present invention, rolling by a tandem kaliber rolling mills (which are generally called "Reducer") is preferable.

EXAMPLES

Figure 2:
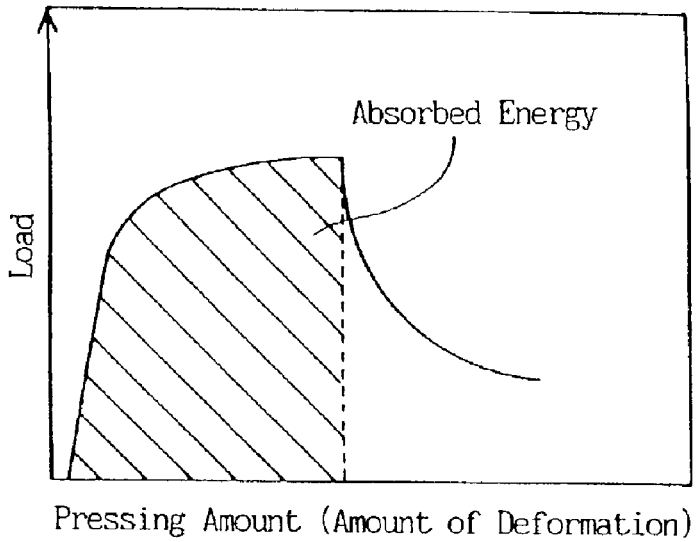
FIG. 2 is an explanatory diagram which shows the definition of the three-point-bending absorption energy value.
Figure 3:
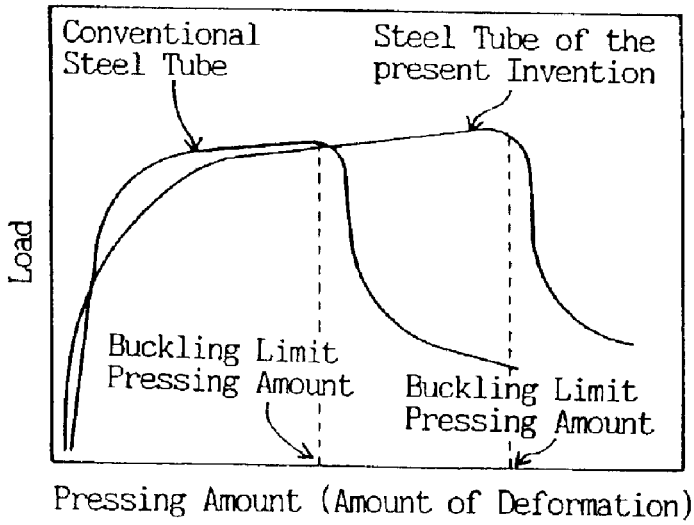
FIG. 3 is a graph which shows the result of the three point bending test of a steel tube of the present invention and the result of the three point bending test of a conventional steel tube.

A hot rolled steel sheet (1.8 or 2.3 mm thickness) having the composition shown in Table 1 was electric resistance welded, whereby a welded steel tube (a electric resistance welded tube having outer diameter of 58 mmϕ) was produced. The obtained welded steel tube was used as mother steel tube. The mother steel tube was subjected to the heating treatment, then to the diameter-reducing rolling process under the conditions shown in FIG. 2, whereby a product tube was obtained. The diameter-reducing rolling was carried out by using a reducer in which rolling mills were tandem-arranged.

The structure, the tensile properties and the three-point-bending property of the obtained product tubes were examined.

(1) Structure

A test piece was taken from each product tube. The structure of the test piece was photographed, at a section of the test piece perpendicular to the longitudinal direction of the tube, by using an optical microscope and a scanning electron microscope. For each of the micrograph structure thus obtained, the types of the constituent structures and the percentage of respective constituent structures were obtained by using an image analyzing device.

(2) Tensile Properties

A JIS No. 11 test piece (a tube-shaped test piece, the gauge length being 50 mm) was taken from each product tube, in the longitudinal direction of the product tube. A tensile test was carried out according to the regulation of JIS Z 2241, whereby yield strength YS, tensile strength TS and elongation El were obtained.

(3) Three-Point-Bending Property

A (tube-shaped) test piece was taken from each product tube. For each test piece, a three point bending test was carried out, as shown in FIG. 1, with the span L being 800 mm or 980 mm and the curvature radius R of the pressing tool being 152.4 mm, whereby the relationship between the load and the pressing amount, as well as the buckling limit pressing amount δ max, which was the maximum pressing amount before buckling occurred, was obtained. In addition, by using the pressing load-pressing amount curve thus obtained, the area between "the pressing load-pressing amount curve from the start of pressing to the buckling limit pressing amount" and "the amount of deformation" axis was obtained, whereby the absorption energy E was defined.

The obtained results are shown in Table 2.

All of the examples of the present invention exhibit excellently high tensile strength (1000 MPa or more), excellently high three-point-bending buckling limit pressing amount, and excellently high three-point-bending absorption energy. On the other hand, in the comparative examples whose compositions are beyond the range of the present invention, the buckling limit pressing amount and the amount of the absorption energy are both low and the three-point-bending property is poor, as compared with the corresponding present examples of the same dimension.

TABLE 1

| Steel | Chemical composition (mass %) | | | | | | | | |
|---|---|---|---|---|---|---|---|---|---|
| No. | C | Si | Mn | P | S | Al | Cu, Nl, Cr, Mo | Nb, V, Ti, B | REM, Ca |
| A | 0.14 | 0.18 | 2.99 | 0.018 | 0.005 | 0.03 | Cr: 0.10 | Nb: 0.020, Ti: 0.015 | — |
| B | 0.09 | 0.21 | 3.10 | 0.021 | 0.005 | 0.04 | Cr: 0.15 | Nb: 0.039 | — |
| C | 0.16 | 0.25 | 2.50 | 0.016 | 0.003 | 0.03 | Cu: 0.12, Nl: 0.15, Mo: 0.15 | NB: 0.015, V: 0.08 | Ca:0.0010 |
| D | 0.22 | 0.19 | 2.00 | 0.018 | 0.003 | 0.03 | Cr: 0.2 | Ti: 0.012, B: 0.0009 | — |
| E | 0.22 | 0.35 | 2.80 | 0.018 | 0.003 | 0.03 | — | — | — |
| F | 0.25 | 0.35 | 1.50 | 0.018 | 0.003 | 0.03 | Cr: 0.5, Mo: 0.10 | Nb: 0.022 | — |

TABLE 2

| Steel | | mother steel tube | | Conditions of diameter-reducing rolling | | | | | Product tube | |
|---|---|---|---|---|---|---|---|---|---|---|
| tube No | Steel No | Outer diameter (mm) | Tube Thickness (mm) | Heating/ Soaking temperature (° C.) | Temperature at which rolling was started (° C.) | Diameter-reducing rate (%) | Temperature at which rolling was finished (° C.) | Cooling after rolling | Outer diameter (mm) | Thickness (mm) |
| 1 | A | 28.6 | 1 6 | — | — | — | as ERW | — | 28 6 | 1 6 |
| 2 | | 58 0 | 1 8 | 800 | 730 | 51 | 680 | Water cooling | 28 6 | 1 6 |
| 3 | | | | 800 | 740 | 51 | 700 | Water cooling | 28 6 | 1 6 |
| 4 | | | | 850 | 780 | 51 | 730 | Water cooling | 28 6 | 1 6 |
| 5 | | 31 8 | 1 6 | — | — | — | as ERW | — | 31.8 | 1 6 |
| 6 | | 58 0 | 1 8 | 750 | 700 | 45 | 650 | Left to be cooled | 31 8 | 1 6 |
| 7 | | | | 750 | 700 | 45 | 650 | Left to be cooled | 31 8 | 1 7 |
| 8 | | 58 0 | 2 3 | 750 | 700 | 45 | 650 | Left to be cooled | 31 8 | 2 0 |
| 9 | | 31 8 | 2 0 | — | — | — | as ERW | — | 31 8 | 2 0 |
| 10 | | 31.8 | 1 6 | — | — | — | as ERW | — | 31 8 | 1 6 |
| 11 | | | | 750 | 710 | 45 | 650 | Left to be cooled | 31 8 | 1.6 |
| 12 | | 58 0 | 1 8 | 860 | 820 | 45 | 750 | Left to be cooled | 31.8 | 1 6 |
| 13 | | | | 980 | 930 | 45 | 850 | Left to be cooled | 31 8 | 1 6 |
| 14 | B | 31.8 | 1 6 | — | — | 0 | as ERW | — | 31 8 | 1.6 |
| 15 | | 58 0 | 1 8 | 870 | 830 | 45 | 750 | Left to be cooled | 31 8 | 1 6 |
| 16 | | | | 1050 | 980 | 45 | 900 | Left to be cooled | 31 8 | 1 6 |
| 17 | C | 58 0 | 2.3 | 800 | 750 | 45 | 700 | Left to be cooled | 31 8 | 2 0 |
| 18 | D | 58 0 | 2 3 | 800 | 750 | 45 | 700 | Left to be cooled | 31 8 | 2 0 |
| 19 | E | 58 0 | 2 3 | 800 | 750 | 45 | 700 | Left to be cooled | 31 8 | 2 0 |
| 20 | F | 58 0 | 2 3 | 800 | 750 | 45 | 700 | Left to be cooled | 31 8 | 2 0 |

| Steel | | Tensile properties | | | | Structure | | Three-point-bending property | | | |
|---|---|---|---|---|---|---|---|---|---|---|---|
| tube No | Steel No | YS MPa | TS MPa | YR % | EL % | Type | Ferrite area rate (%) | Bending span L (mm) | Buckling limit pressing amount δ (mm) | Absorbed energy before buckling E (J) | Note |
| 1 | A | 1093 | 1190 | 92 | 7 | B* | — | 800 | 80 | 350 | Comparative Example |
| 2 | | 739 | 1337 | 55 | 22 | M + F | 8 | 800 | 125 | 450 | Present Example |
| 3 | | 882 | 1370 | 64 | 18 | M, B | — | 800 | 100 | 460 | Present Example |
| 4 | | 660 | 1201 | 55 | 24 | M + F | 12 | 800 | 130 | 420 | Present Example |
| 5 | | 1129 | 1213 | 93 | 9 | B* | — | 800 | 60 | 385 | Comparative Example |
| 6 | | 844 | 1291 | 65 | 18 | M, B + F | 6 | 800 | 76 | 465 | Present Example |
| 7 | | 853 | 1305 | 65 | 18 | M, B + F | 8 | 800 | 91 | 724 | Present Example |
| 8 | | 980 | 1390 | 71 | 16 | M, B + F | 9 | 800 | 100 | 960 | Present Example |
| 9 | | 1145 | 1220 | 94 | 10 | B* | — | 800 | 67 | 649 | Comparative Example |

TABLE 2-continued

| | | | | | | | | | | | |
|---|---|---|---|---|---|---|---|---|---|---|---|
| 10 | | 1129 | 1213 | 93 | 9 | B* | — | 980 | 76 | 398 | Comparative Example |
| 11 | | 1066 | 1396 | 76 | 19 | M, B + F | 6 | 980 | 100 | 561 | Present Example |
| 12 | | 830 | 1089 | 76 | 18 | M, B + F | 6 | 980 | 110 | 470 | Present Example |
| 13 | | 602 | 990 | 61 | 15 | B* | — | 980 | 95 | 395 | Comparative Example |
| 14 | B | 921 | 1090 | 84 | 14 | B* | — | 980 | 85 | 376 | Comparative Example |
| 15 | | 666 | 1009 | 66 | 22 | M, B + F | 7 | 980 | 100 | 480 | Present Example |
| 16 | | 600 | 890 | 67 | 24 | B* | — | 980 | 95 | 365 | Comparative Example |
| 17 | C | 1076 | 1380 | 78 | 18 | M + F | 3 | 800 | 105 | 1160 | Present Example |
| 18 | D | 1013 | 1350 | 75 | 19 | M + F | 3 | 800 | 115 | 1200 | Present Example |
| 19 | E | 1078 | 1400 | 77 | 16 | M, B + F | 10 | 800 | 110 | 1250 | Present Example |
| 20 | F | 679 | 970 | 70 | 16 | M, B + F | 25 | 800 | 70 | 700 | Comparative Example |

B*: Bainite (by reheated γ),
B: Bainite,
M: martensite,
F: Ferrite

INDUSTRIAL APPLICABILITY OF THE PRESENT INVENTION

According to the invention, the production efficiency can be enhanced and the production cost can be reduced in the steel tube production, without necessitating any off-line heat treatment. In addition, according to the present invention, the three-point-bending absorbed energy is increased and thus the thickness of the steel tube can be made thinner and the weight of a automobile can be significantly reduced, which is extremely advantageous in industrial terms.

What is claimed is:

1. A steel tube for reinforcing a automobile door, having a composition comprising:

0.05 to 0.22 mass % of C;

0.01 to 2.0 mass % of Si;

2.5 to 3.5 mass % of Mn;

0.005 to 0.10 mass % of Al; and the remainder as Fe and unavoidable impurities, wherein the steel tube has tensile strength of no less than 1000 MPa and has an absorbed energy before buckling of at least 1160 E(J) and is excellent in three-point-bending property.

2. A steel tube for reinforcing a automobile door according to claim 1, wherein the steel tube has a structure which is constituted of martensite and/or bainite, and the martensite and/or bainite is a transformation product obtained as a result of transformation of a deformed austenite.

3. A steel tube for reinforcing a automobile door according to claim 1, wherein the steel tube has a structure which is a mixture of martensite and/or bainite and ferrite, and the martensite and/or bainite is a transformation product obtained as a result of transformation of a deformed austenite.

4. A steel tube for reinforcing a automobile door according to claim 3, wherein the content of ferrite, expressed as the area ratio, is no more than 20%.

5. A steel tube for reinforcing a automobile door according to claim 1, wherein the yield ratio of the steel tube is no larger than 80%.

6. A steel tube for reinforcing a automobile door of any according to claim 1, wherein the steel tube has at least one composition selected from the group consisting of composition A, composition B and composition C described below, in addition to the aforementioned composition:

Composition A: at least one type of element selected from the group consisting of: no more than 1 mass % of Cu; no more than 1 mass % of Ni; from 0 mass % to no more than 0.5 mass % of Cr; and no more than 1 mass % of Mo;

Composition B: at least one type of element selected from the group consisting of: no more than 0.1 mass % of Nb; no more than 0.5 mass % of V; no more than 0.2 mass % of Ti; and no more than 0.003 mass % of B;

Composition C: at least one selected from the group consisting of: no more than 0.02 mass % of REM; and no more than 0.01 mass % of Ca.

7. A method of producing a steel tube for reinforcing an automobile door, comprising the steps of:

preparing a mother steel tube having a composition which includes: 0.05 to 0.22 mass % of C; 0.01 to 2.0 mass % of Si; 2.5 to 3.5 mass % of Mn; 0.005 to 0.10 mass % of Al; and the remainder as Fe and unavoidable impurities;

subjecting the mother steel tube to a heating or soaking treatment; and thereafter, subjecting the mother steel tube to a diameter-reducing rolling process in which the total diameter-reduction rate is no less than 20% and the temperature at which the diameter-reducing rolling process is finished is 750° C. or less to provide a finished steel tube with a tensile strength of at least 1000 MPa.

8. A method of producing a steel tube for reinforcing a automobile door according to claim 7, wherein the steel tube has at least one composition selected from the group consisting of composition A, composition B and composition C described below, in addition to the aforementioned composition:

Composition A: at least one type of element selected from the group consisting of: no more than 1 mass % of Cu; no more than 1 mass % of Ni; from 0 mass % to no more than 0.5 mass % of Cr; and no more than 1 mass % of Mo;

Composition B: at least one type of element selected from the group consisting of: no more than 0.1 mass % of Nb; 0.5 mass % of V; no more than 0.2 mass % of Ti; and no more than 0.003 mass % of B;

Composition C: at least one selected from the group consisting of: no more than 0.02 mass % of REM; and 0.01 mass % of Ca.

9. The method of claim 7, wherein the produced steel tube has an absorbed energy before buckling of at least 1160 E(J).

* * * * *